US010858020B2

(12) United States Patent
Naidu

(10) Patent No.: US 10,858,020 B2
(45) Date of Patent: Dec. 8, 2020

(54) SYSTEMS AND METHODS FOR USING A RAILROAD RAIL AS RADIATING ELEMENT FOR TRANSMITTING WIRELESS COMMUNICATIONS SIGNALS

(71) Applicant: Meteorcomm LLC, Renton, WA (US)

(72) Inventor: Arun Naidu, Woodinville, WA (US)

(73) Assignee: Meteorcomm LLC, Renton, WA (US)

( * ) Notice: Subject to any disclaimer, the term of this patent is extended or adjusted under 35 U.S.C. 154(b) by 289 days.

(21) Appl. No.: 15/817,280

(22) Filed: Nov. 19, 2017

(65) Prior Publication Data

US 2018/0072334 A1 Mar. 15, 2018

Related U.S. Application Data

(63) Continuation of application No. 14/503,981, filed on Oct. 1, 2014, now Pat. No. 9,840,260.

(60) Provisional application No. 61/983,769, filed on Apr. 24, 2014.

(51) Int. Cl.

| | |
|---|---|
| ***B61L 3/22*** | (2006.01) |
| ***B61L 15/00*** | (2006.01) |
| ***B61L 3/12*** | (2006.01) |
| *B61L 27/00* | (2006.01) |

(52) U.S. Cl.

CPC ..... *B61L 15/0027* (2013.01); *B61L 3/125* (2013.01); *B61L 3/227* (2013.01); *B61L 15/0072* (2013.01); *B61L 27/00* (2013.01)

(58) Field of Classification Search

CPC ..... B61L 23/06; B61L 3/125; B61L 3/227; B61L 27/0005; B61L 27/0094; B61L 15/00; B61L 15/0027; B61L 15/0072; B61L 27/00; B61L 3/22; A63H 19/24; A63H 30/04; G08B 21/02; H04B 5/00; H04B 5/0025; H04B 5/0075; H04B 5/0018

See application file for complete search history.

(56) References Cited

U.S. PATENT DOCUMENTS

| | | | | |
|---|---|---|---|---|
| 4,225,081 | A | 9/1980 | Ikegame | |
| 5,749,547 | A | 5/1998 | Young et al. | |
| 6,145,792 | A | 11/2000 | Penza et al. | |
| 6,234,428 | B1 | 5/2001 | Bachtiger et al. | |
| 7,543,372 | B2 | 6/2009 | Reichle | |
| 8,279,796 | B1 | 10/2012 | Cleveland et al. | |
| 8,340,056 | B2 | 12/2012 | Siriwongpairat et al. | |
| 8,344,877 | B2 * | 1/2013 | Sheardown ..... | B61L 23/06 246/122 R |
| 8,374,291 | B1 | 2/2013 | Himsoon et al. | |
| 8,605,754 | B2 | 12/2013 | Siriwongpairat et al. | |
| 2003/0010872 | A1 | 1/2003 | Lewin et al. | |

(Continued)

OTHER PUBLICATIONS

Office Action received in Canadian Application No. 2,888,557 dated Jun. 3, 2016, 4 pages.

(Continued)

*Primary Examiner* — Mark T Le

(74) *Attorney, Agent, or Firm* — Hubbard Johnston PLLC

(57) ABSTRACT

A railroad communication system includes a radio transmitter for generating radio communications signals and a length of railroad rail coupled to the radio transmitter. The length of rail is disposed on a set of nonconductive railroad ties to form a transmission line for radiating the radio communications signals to a radio receiver in a vicinity of the length of railroad rail.

18 Claims, 6 Drawing Sheets

(56) References Cited

U.S. PATENT DOCUMENTS

| | | | |
|---|---|---|---|
| 2003/0205626 | A1 | 11/2003 | Hansen |
| 2005/0184198 | A1 | 8/2005 | Pierson |
| 2006/0160434 | A1 | 7/2006 | Pettersen |
| 2011/0006912 | A1 | 1/2011 | Sheardown et al. |

OTHER PUBLICATIONS

WireYourOwnHouse.com, "Grounding the Service," http://wireyourownhouse.com/panel/grounding.html, 2010, 5 pages.
Jarrett, K. W. et al., "Traditional Transmission Media for Networking and Telecommunications,"Coaxial Cable, Oct. 2007, 3 pages.

* cited by examiner

SYSTEMS AND METHODS FOR USING A RAILROAD RAIL AS RADIATING ELEMENT FOR TRANSMITTING WIRELESS COMMUNICATIONS SIGNALS

CROSS-REFERENCE TO RELATED APPLICATION

This application is a Continuation of U.S. patent application Ser. No. 14/503,981 filed Oct. 1, 2014, which this application claims the benefit of U.S. Provisional Application No. 61/983,769, filed Apr. 24, 2014. The above identified applications are incorporated by reference herein.

FIELD OF INVENTION

The present invention relates in general to the wireless transmission of communications signals, and in particular to systems and methods for using a railroad rail as a radiating element for transmitting wireless communications signals.

BACKGROUND OF INVENTION

Railroads use a number of different wireless communications systems, including radios, in their operations. For example, radio communications between locomotives and waysides is an important component of the Positive Train Control (PTC) system being implemented in the United States. In addition, railroads rely on radios to communicate with personnel out in the field, including those working in the proximity of active railroad tracks. Hence improving railroad radio communications capabilities is an important factor in ensuring safe and efficient railroad operations.

SUMMARY OF INVENTION

The principles of the present invention are generally embodied in systems and methods in which a conventional railroad rail is used to carry and radiate radio frequency (RF) signals at one or more frequencies to nearby radio receivers. Among other things, these systems and methods support the transmission of messages to alert rail side workers of an approaching train, transmit positive train control (PTC) messages between locomotives and wayside radio units, as well as provide a radio frequency transmission structure suitable for other railway radio communications applications.

One particular representative embodiment of the principles of the present invention is a railroad communication system, which includes a radio transmitter for generating radio communications signals and a length of railroad rail coupled to the radio transmitter. The length of rail is disposed on a set of nonconductive railroad ties to form a transmission line for radiating the radio communications signals to a radio receiver in a vicinity.

Among other things, the present principles take advantage of the existing railroad infrastructure as a component in an extensive communications system that is critical for maintaining efficient railroad operations and safety. Advantageously, these principles can be applied to rail blocks having rails separated by insulators for maintaining DC communications or for continuous rail systems. Existing radios, such as those used in the PTC system, can suitably be used to generate the transmit signals, as well as receive signals radiated from the rail.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in FIGS. 1-8 of the drawings, in which like numbers designate like parts.

The structure formed by a conventional railroad sitting on a conventional railroad tie is similar to that of a microstrip transmission line, although the relative dimensions of the railroad rail are much larger than that of the typical microstrip line used in small-scale electrical systems, such as printed circuit boards. As a result, a rail can be used as a transmission line for carrying and radiating radio frequency signals at several different frequencies. These signals could, for example, carry warning messages to alert rail side workers of an approaching train, transmit positive train control (PTC) messages from wayside radio units to nearby locomotives, and carry similar signals needed for implementing various other railway communications.

Figure 1:
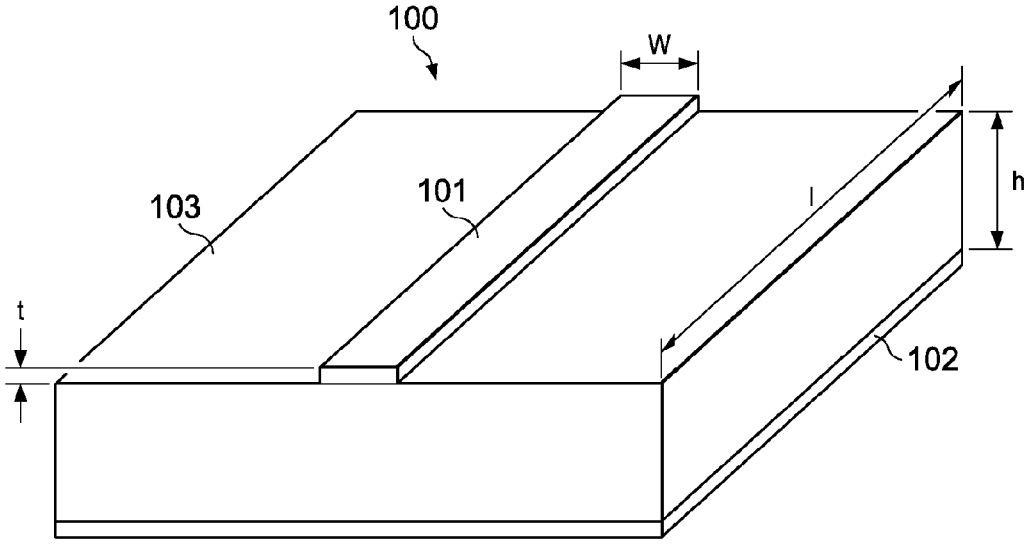
FIG. 1 (Prior Art)
FIG. 1 is a conceptual diagram of a small section of a microstrip structure commonly used as a transmission line for carrying electrical signals.

More specifically, FIG. 1 illustrates a conventional microstrip structure 100 used as a transmission line for radio frequency (RF) and microwave signals. In exemplary microstrip structure 100, a microstrip 101, which a strip of conductive material having a width W, a length l, and a thickness t, is separated from a ground plane 102 by a layer of dielectric 103 of thickness h.

Figure 2:
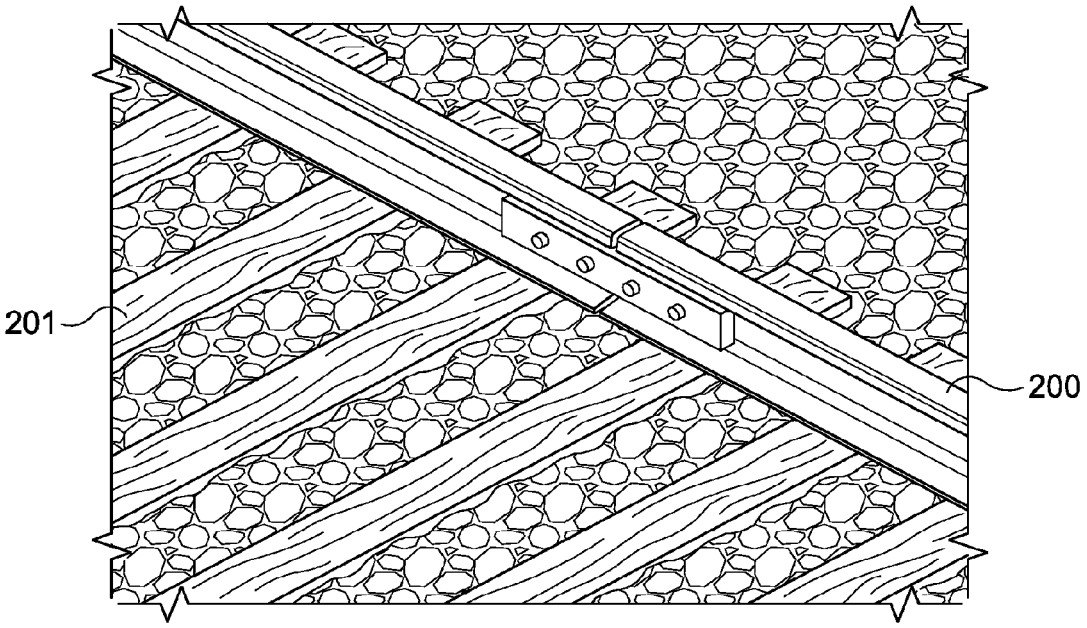
FIG. 2 (Prior Art)
FIG. 2 is a perspective view of a small section of conventional railroad track, including a portion of one of a pair of parallel rails and their associated ties.
Figure 3:
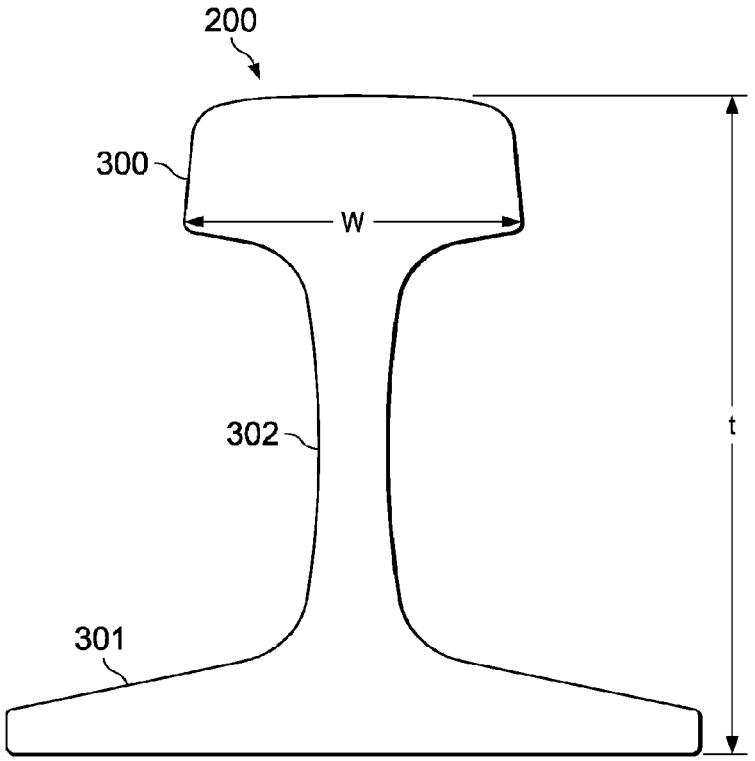
FIG. 3 (Prior Art)
FIG. 3 is a cross-sectional view of a section of conventional railroad rail.
Figure 4:
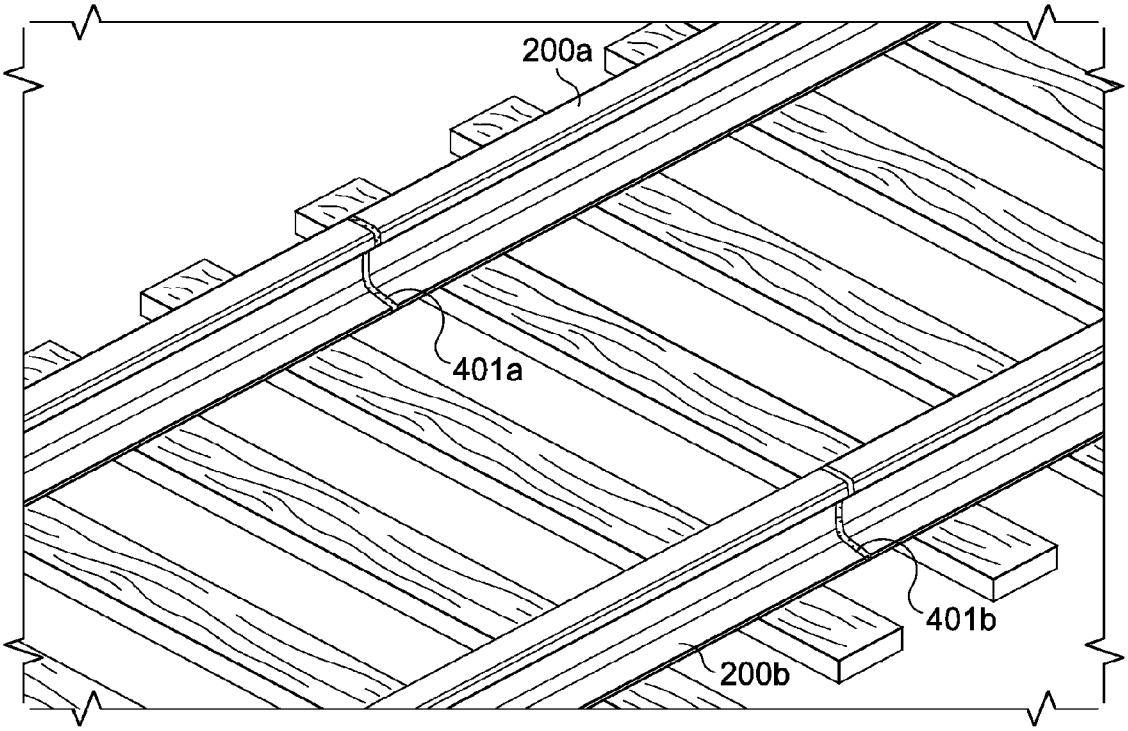
FIG. 4 (Prior Art)
FIG. 4 is a perspective view illustrating the insulators between a pair of conventional rails of a small section of a conventional railroad track.

For comparison, a small section of conventional railroad rail 200 is shown in FIG. 2, along with its cross-section in FIG. 3. Rail 200 includes a head 300, a base 301, and a web 302. A typical heavy freight rail is about $2\frac{23}{32}$" wide across head 300 (i.e., W=$2\frac{23}{32}$") and about $6\frac{5}{8}$" tall, as measured from the bottom of base 301 to the top of head 300 (i.e., t=$6\frac{5}{8}$"). As shown in FIG. 2, the typical heavy freight rail is suspended over the ground by 7" tall ties 201 (i.e., h=7"). Using these figures for W, t, and h respectively, the characteristic impedance of a rail as microstrip is approximately 180 Ohms.

A simulation was performed in which these rail dimensions were entered into an Method of Moments electromagnetic simulation tool and driven with a source signal at 220 MHz, which is the nominal communications frequency used in the PTC system. Included in the simulation was a ⅛" gap with a Kevlar insulator 401 (FIG. 4), typically used for electrically isolating adjacent track blocks when the rail is used for DC signaling. (The principles of the present invention are equally applicable to continuously welded tracks, which use audio signaling detectors, which are not affected by RF signals.)

Figure 5:
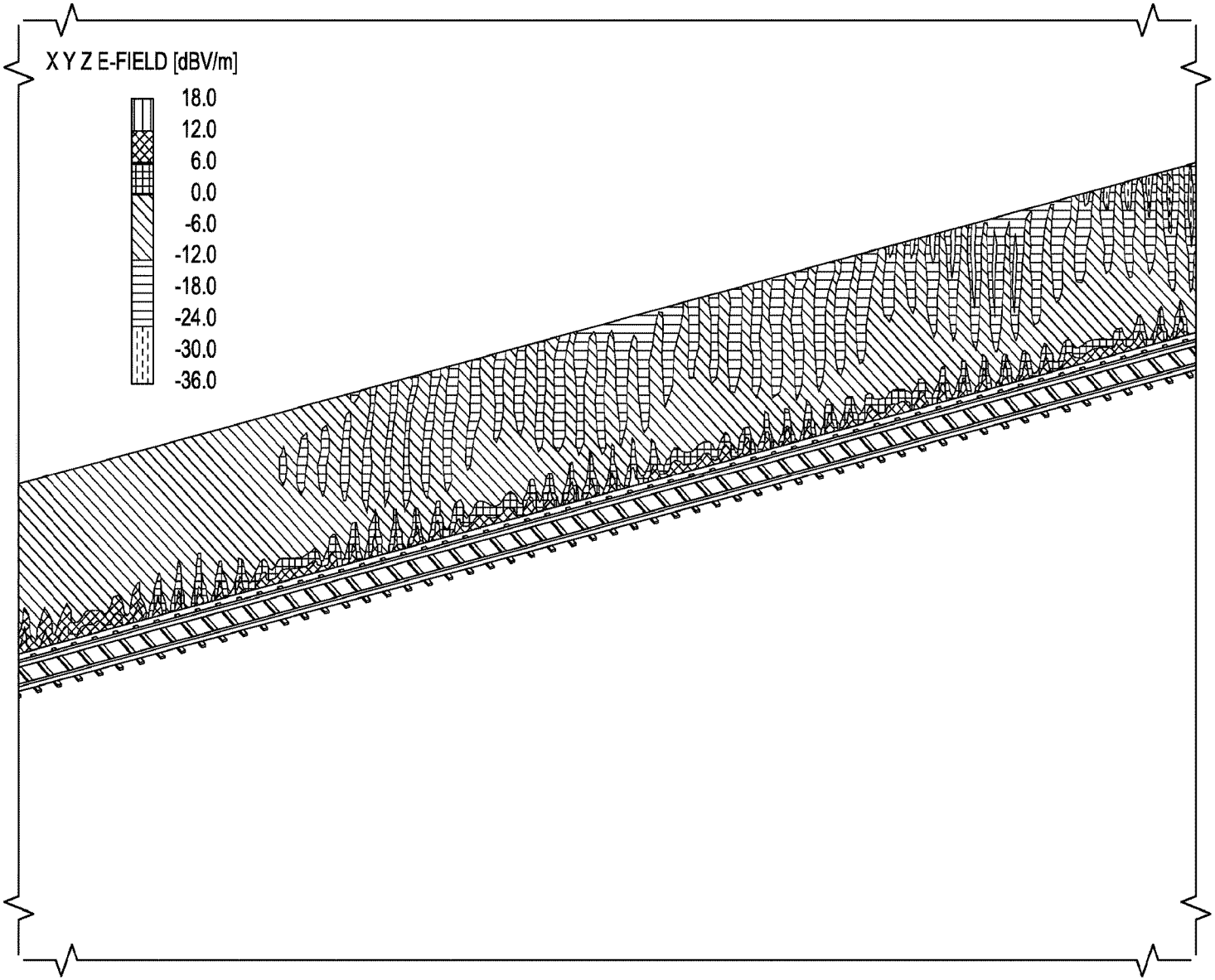
FIG. 5 illustrates the radiated signal strength along a representative section of railroad track operating as a radiator according to the principles of the present invention.

FIG. 5 shows the simulated radiated signal strength along a length of the track and demonstrates that an electric field (e:) of −6 dBV/m can be consistently achieved, which is well above the minimum signal level requirements of current radio receivers. Under the simulated conditions, the electrical field was found to be sufficient to support communications with the handheld radios carried by railroad workers within a nominal 1500 foot radius along a nominal 1000 foot radiating length of track 200. (While the −6 dBV/m value for the electric field was determined through simulation using the exemplary dimensions described above for the rail and ties, the actual value for the electrical field strength may vary in actual implementations, depending on such factors as differences in rail head width, rail height, tie height, transmitter power, and so on. Given the physical dimensions of the track and ties, the transmitter power may accordingly be varied depending on the desired size of the communications area surrounding the radiating track. For example, depending on the transmitter, the radial coverage of the electrical field could be extended beyond the simulated 1500 foot nominal radius and/or the length of the radiating section of track extended beyond the simulated 1000 feet to a mile or more.)

This ability of the rail to radiate signals therefore advantageously allows for the implementation of numerous communication applications between devices in close proximity of the rails. In other words, the rail becomes part of the communications link between radios located near the rail and a wireless aggregation radio located at wayside. Two exemplary implementations are shown in FIGS. 6 and 7.

Figure 6:
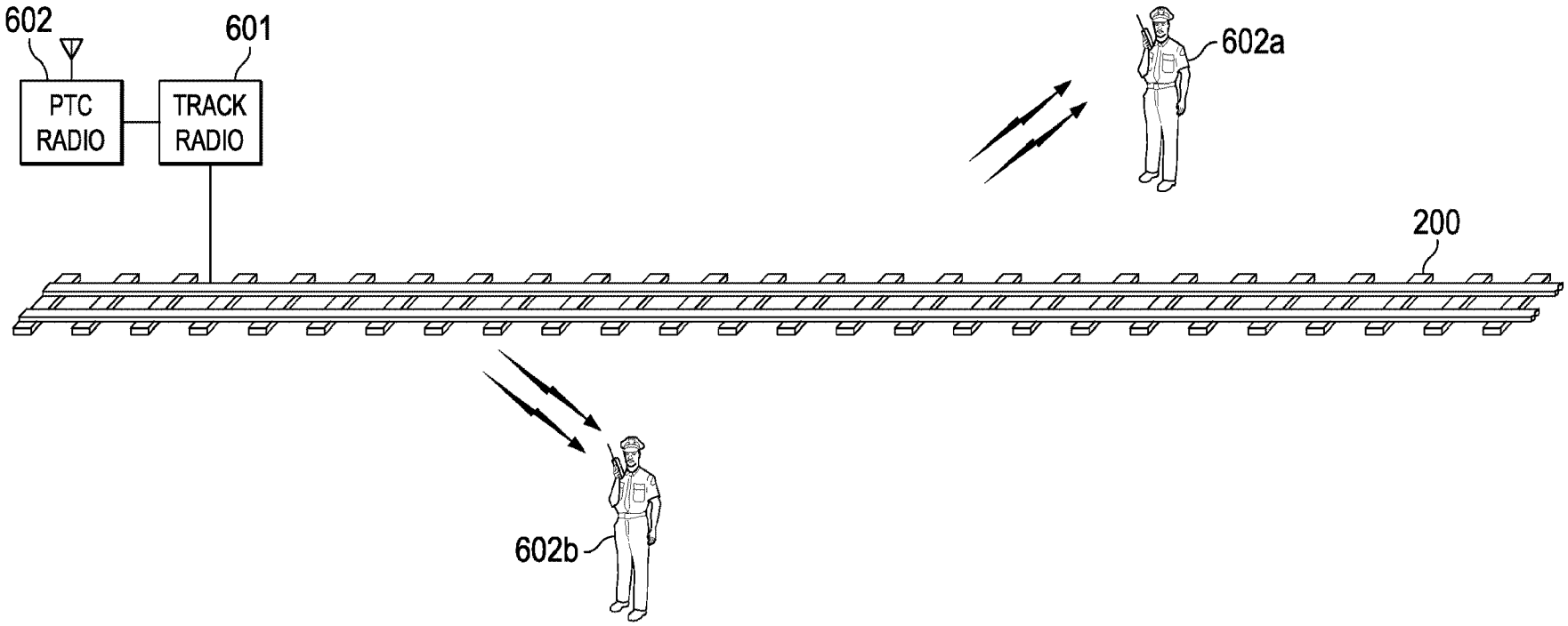
FIG. 6 illustrates a representative application of the present inventive principles in which a radio transmits a wireless warning signal using a railroad rail as a radiating element to another radio carried by a worker working trackside in the vicinity of the railroad rail.

In FIG. 6, a wayside PTC radio 600 and an optional track radio 601 transmit messages to the radio receivers 602*a* and 602*b* carried railroad workers in the vicinity of rail 200. These messages could carry, for example, warnings about the approach of a train on the track. PCT radio 600 and track radio 601, as well as the required modulation and messaging protocols, could be, for example, those described in U.S. Pat. Nos. 8,279,796, 8,340,056. 8,374,291, and 8,605,754, which are incorporated herein for all purposes. Optional track radio 601 is preferably used when a different frequency, modulation, or messaging protocol from that used by PTC radio 600 is desired.

Figure 7:
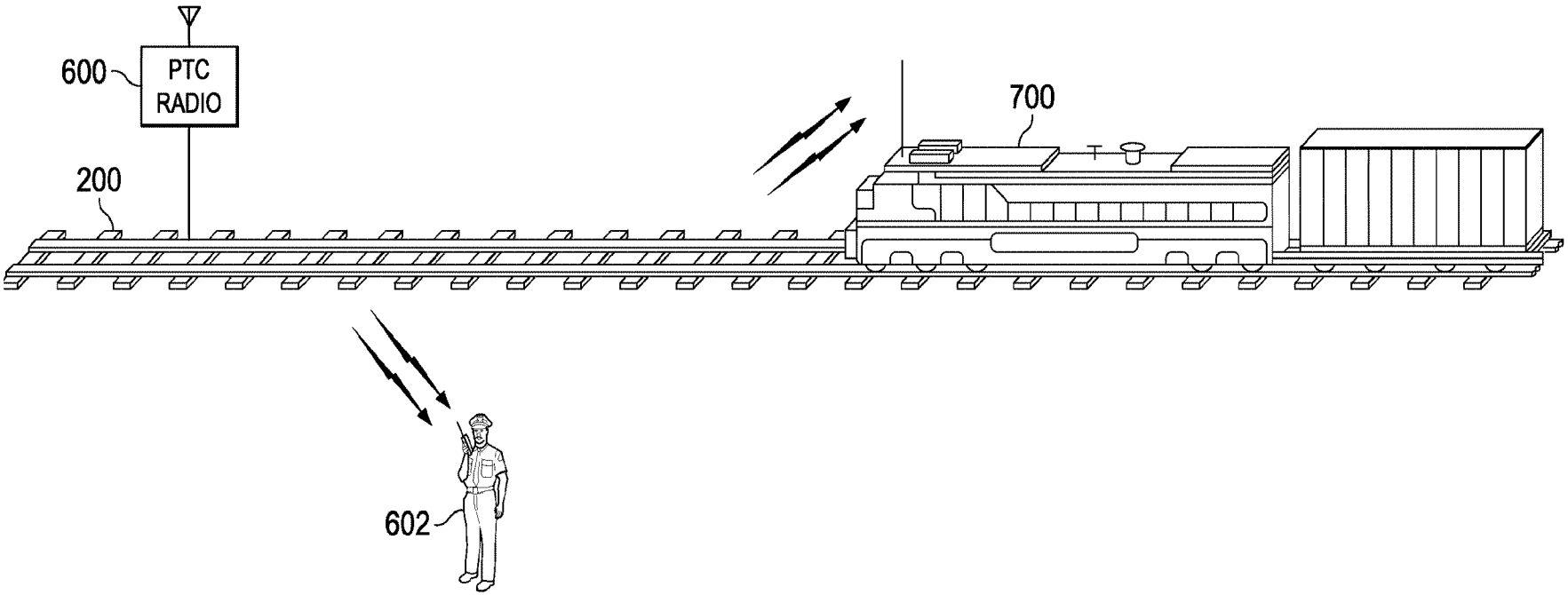
FIG. 7 illustrates another representative application of the inventive principles in which a wayside radio transmits wireless signals using a railroad track as a radiating element to another radio on a locomotive on the railroad rail.

In FIG. 7, a similar PTC radio 600 at a wayside is shown transmitting PTC messages to a corresponding radio on a train locomotive 700 using one of the rails 200 of the track as a radiator. An electric field of −6 dBV/m advantageously provides sufficient signal strength at the height of the locomotive 700 PTC antenna for reliable message transmission.

Figure 8:
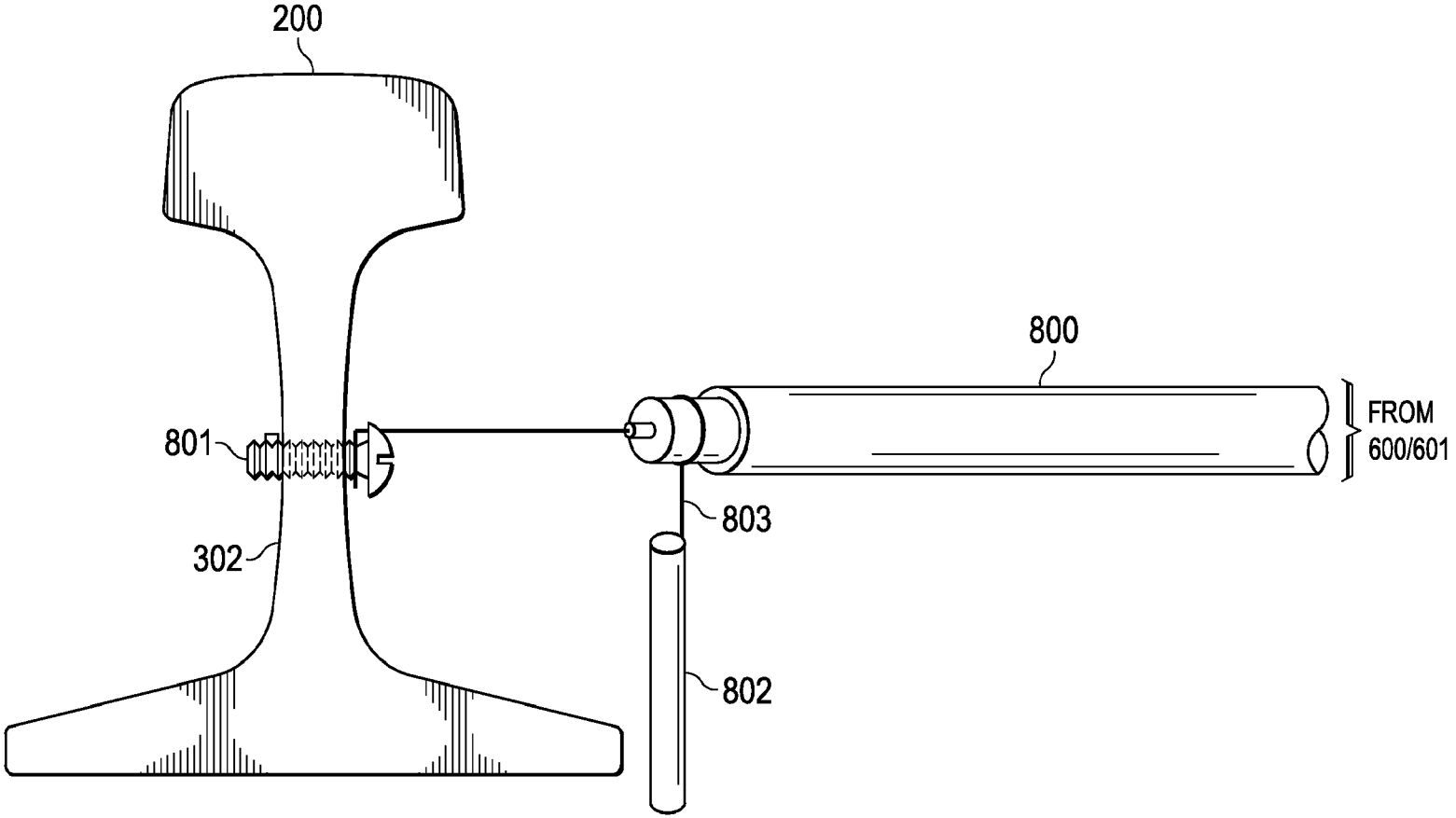
FIG. 8 shows exemplary interconnection between an transmitting radio and a railroad rail being used as a radiating element for transmitting wireless signals.

A preferred interconnection between the PCT and/or track radios 600 and 601 shown in FIGS. 6 and 7 and the rail being used as a radiator is shown in FIG. 8. In the embodiment shown in FIG. 8, a coaxial cable 800 carries the RF signal transmitted by PTC radio 600, for the system shown in FIG. 7, or by track radio 601, for the system shown in FIG. 6, to rail 200. The center conductor of coaxial cable 800 couples to rail 200 through a bolt 801, which preferably extends through an existing hole in web 302. In alternate embodiments, conductive tape or conductive epoxy may be used to couple the center conductor of coaxial cable 800 to rail web 305 in lieu of bolt 801. The shield of coaxial cable 800 is grounded through a ground rod 802 and a ground lead 803. In alternate embodiments, different radio-to-rail interconnection techniques may be used.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A railroad communication system comprising:

a wayside Positive Train Control (PTC) radio transmitter for communicating PTC messages through radio communications signals; and a length of heavy freight railroad rail coupled to the wayside Positive Train Control (PTC) radio transmitter and disposed on a set of nonconductive railroad ties to form a transmission line for radiating the radio communications signals with an electric field sufficient for communication of RF signals with enough strength at the height of a locomotive PTC antenna mounted on top of a locomotive for reliable transmission of PTC messages.

2. The railroad communication system of claim 1, wherein the electric field has a strength of −6 dBV/m.

3. The system of claim 1, further comprising a radio receiver carried by a railroad worker in the vicinity of the length of railroad rail.

4. The system of claim 1, wherein the wayside Positive Train Control (PTC) radio transmitter is coupled to the length of heavy freight railroad rail through a track radio transmitter.

5. The system of claim 4, wherein the track radio transmitter receives signals with PTC messages from a PTC radio system.

6. The system of claim 1, further comprising a PTC radio receiver disposed on the locomotive and connected with the PTC antenna.

7. The system of claim 1, wherein the length of rail comprises a portion of a rail block separated from an adjacent rail block by an insulator.

8. The system of claim 1, wherein the length of rail comprises a portion of a continuous rail.

9. A method for radio communication in a railroad system comprising:

coupling a wayside Positive Train Control (PTC) radio transmitter to a length of railroad rail disposed on a plurality of railroad ties to form a transmission line; and transmitting PTC messages from the wayside PTC radio transmitter to a radio receiver on a locomotive by transmitting communication signals through the length of railroad rail to an antenna mounted on top of a locomotive.

10. The method of claim 9, wherein transmitting radio communications signals comprises transmitting the PTC messages to a radio receiver associated with personnel working in the vicinity of the length of railroad rail.

11. The method of claim 10, wherein transmitting messages to a radio receiver associated with personnel working in the vicinity of the length of railroad track comprises transmitting warning messages.

12. The method of claim 9, wherein the transmitting of radio communications signals from the length of railroad rail comprises transmitting radio communications signals to a train in the vicinity of the length of rail.

13. The method of claim 9, wherein coupling the wayside PTC radio transmitter to a length of railroad rail comprises coupling the wayside PTC radio transmitter through a track radio transmitter to the length of railroad rail.

14. The method of claim 9, wherein coupling the wayside PTC radio transmitter to a length of railroad rail comprises coupling the wayside PTC radio transmitter to a length of railroad rail through a coaxial cable.

15. The method of claim 14, wherein coupling the wayside PTC radio transmitter to a length of railroad rail through a coaxial cable comprises:

coupling a center conductor of the coaxial cable to a bolt disposed through an aperture through a web of the length of railroad rail; and coupling a shield of the coaxial cable to a grounding rod.

16. The method of claim 14, wherein coupling the wayside PTC radio transmitter to a length of railroad rail through a coaxial cable comprises:

coupling a center conductor of the coaxial cable to a web of the length of rail with a conductive adhesive; and coupling a shield of the coaxial cable to a grounding rod.

17. The method of claim 9, wherein the radio communications signals are radiated with an electric field having a strength of −6 dBV/m.

18. The method of claim 9, wherein the rails are heavy freight rails positioned above the ground by ties.

* * * * *